United States Patent [19]

Hammerl et al.

[11] Patent Number: 4,870,546

[45] Date of Patent: Sep. 26, 1989

[54] ELECTRIC LIGHTING DEVICE FOR HOUSEHOLD APPLIANCES SUCH AS OVENS

[75] Inventors: Günter Hammerl, Bad Reichenhall; Kurt Lintner, Traunreut; Josef Krautscheid, Trostberg; Johann Klement, Traunwalchen, all of Fed. Rep. of Germany

[73] Assignee: Bosch-Siemens Hausgeräte GmbH, Munich, Fed. Rep. of Germany

[21] Appl. No.: 285,013

[22] Filed: Dec. 15, 1988

[30] Foreign Application Priority Data

Dec. 15, 1987 [DE] Fed. Rep. of Germany ..... 3742509

[51] Int. Cl.[4] ..... F21V 33/00

[52] U.S. Cl. ..... 362/92; 362/226; 362/376; 313/318

[58] Field of Search ..... 362/92, 226, 376, 378, 362/458, 457, 253, 154, 382; 439/92, 93, 95, 108, 250; 313/318, 324; 126/97, 213; 99/341

[56] References Cited

U.S. PATENT DOCUMENTS

| | | | |
|---|---|---|---|
| 3,639,750 | 2/1972 | Anthonijsz | 362/226 |
| 4,222,623 | 9/1980 | Hultberg | 362/376 |
| 4,326,243 | 4/1982 | Pistor et al. | 362/92 |

FOREIGN PATENT DOCUMENTS

| | | | |
|---|---|---|---|
| 0078030 | 5/1983 | European Pat. Off. | 313/318 |
| 406613 | 6/1921 | Fed. Rep. of Germany | 362/376 |

*Primary Examiner*—Ira S. Lazarus
*Assistant Examiner*—D. M. Cox
*Attorney, Agent, or Firm*—Herbert L. Lerner; Laurence A. Greenberg

[57] ABSTRACT

A lighting device for household appliances such as ovens, includes an electric lamp socket formed of electrically insulating material preventing leakage currents. Contact parts are disposed in the socket. The socket has an access side with a plug-in opening formed therein into which a lamp with a glass bulb, a lamp base of insulating material and contact prongs protruding from the lamp base is to be plugged into contact with the contact parts in a given plug-in direction. An electrically conductive and protectively grounded protective element covers at least the access side of the lamp socket and extends to the vicinity of at least one of the glass bulb and the lamp base. The protective element and the contact parts are spaced apart by a distance being greater than the length of the contact prongs by a required margin of safety, as seen in the given plug-in direction.

6 Claims, 2 Drawing Sheets

ELECTRIC LIGHTING DEVICE FOR HOUSEHOLD APPLIANCES SUCH AS OVENS

Figure 1:
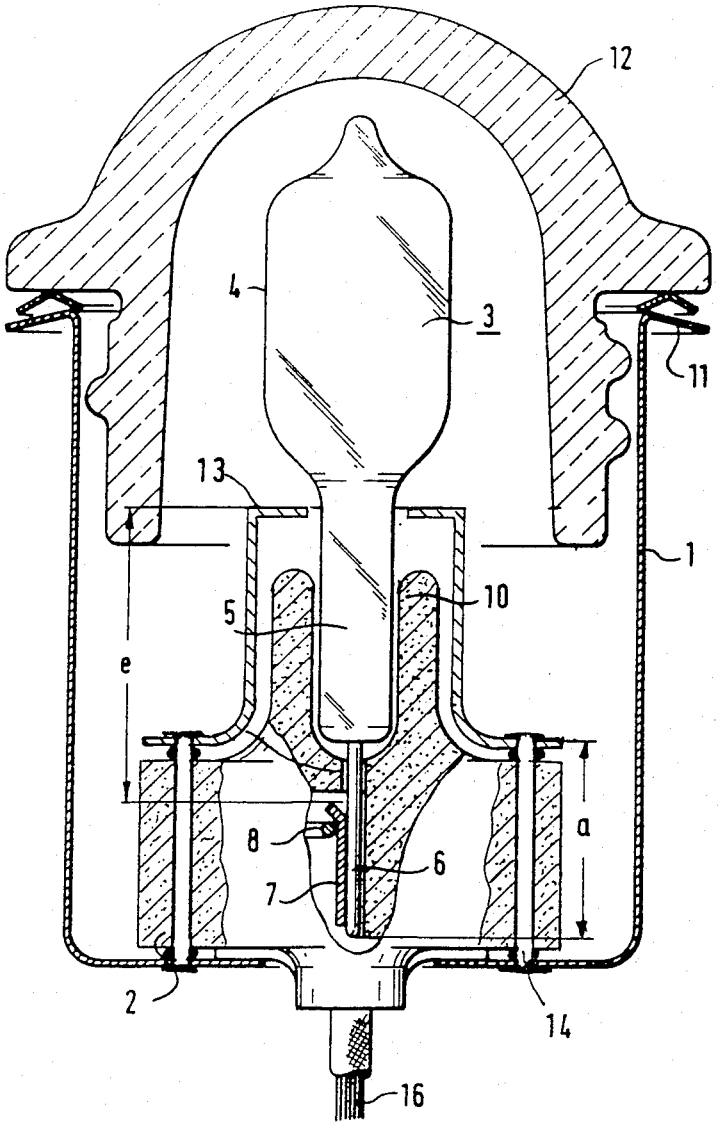

The invention relates to an electric lighting device for household appliances such as ovens, having an electrical lamp socket of insulating material with contact parts, into which a lamp having a lamp base of insulating material can be plugged with its contact prongs protruding from the lamp base into contact with the contact parts of the lamp base. Associated with the plug-in opening of the lamp base are protective elements of electrically insulating material, which extend over a length of the lamp plug motion that is longer than the plug contact path or than the length of the contact prongs, with the desired margin of safety.

Lighting devices of this kind may be independent electrical lights that are disposed in household appliances, or they may be an integral component of household appliances.

With such electrical lighting devices safety considerations require that when the lamp is plugged in and unplugged, it should not be possible to touch current-carrying contact parts even if a person handles them clumsily. Moreover, care should be taken to ensure that sufficiently long spacings, in the form of a free space and an insulating material path, remain between current-carrying parts and touchable or contactable areas as well as other electrically conductive materials, so that the danger of electrical sparkovers and the risk that electrical leakage paths will develop between the current- carrying parts and touchable areas as well as other electrically conductive parts, are precluded to the greatest possible extent.

Thus it is required that touchable metal parts which are connected to a protective conductor be separated from voltage-carrying parts at an operating voltage of up to 130 V, by an operating insulation, while taking into account an air gap of at least 1.5 mm and a leakage path through the insulating material of at least 2.0 mm. Since voltage overloads can also arise in household appliances, even longer safety spacings from voltage-carrying parts must be provided for touchable glass bulbs of lamps, in such a way that a test voltage of 2750 V at the voltage-carrying parts does not prove harmful, as measured at the point on the glass bulb that is still touchable in the most unfavorable case. To this end, air gaps of at least 8.0 mm and leakage paths leading past the insulating material of at least 8.0 mm must be provided.

In an electric light for household appliances, such as is known from German Utility Model DE-GM 87 11 524, touch-prevention elements may, for instance, be disposed in the plug-in opening of the lamp socket, in order to form a protective gap that prevents manual access over a length of the lamp plug motion exceeding the plug contact path or the length of the contact prong between the contact prongs and the plug-in side for the light. These touch-prevention elements are made of electrically insulating material and are associated selectively with either the lamp or the lamp base of the electric light.

It is accordingly an object of the invention to provide an electric lighting device for household appliances such as ovens, which overcomes the hereinafore-mentioned disadvantages of the heretofore-known devices of this general type and to do so in such a way that not only is touching of current-carrying parts precluded entirely, but moreover, sufficient protection against the formation of electrical sparkovers and leakage paths in the event of overloads is provided. These provisions should in particular be usable in combination with small installation dimensions and compact configurations, as is typically the case with lighting devices having plug-in base sockets, or in other words in particular for so-called low-voltage lamps, such as halogen lamps.

With the foregoing and other objects in view there is provided, in accordance with the invention, a lighting device for household appliances such as ovens, comprising an electric lamp socket formed of electrically insulating material preventing leakage currents, contact parts disposed in the socket, the socket having an access side with a plug-in opening formed therein into which a lamp with a glass bulb, a lamp base of insulating material and contact prongs protruding from the lamp base is to be plugged into contact with the contact parts in a given plug-in direction, and an electrically conductive and protectively grounded protective element covering at least the access side of the lamp socket and extending to the vicinity of at least one of the glass bulb and the lamp base, the protective element and the contact parts being spaced apart by a distance being greater than the length of the contact prongs by a required margin of safety, as seen in the given plug-in direction.

These features of the invention assure that a protectively grounded protective element provides reliable touch protection with respect to the current-carrying parts of the lamp base as well as the contact prongs of the lamp, especially when the bulb is being changed. Sparkovers and leakage currents that occur despite the insulating provisions are thus rendered harmless to people in a reliable manner by the provisions which are taken.

In accordance with another feature of the invention, the electrically conductive and protectively grounded protective element is a flat bar disposed in front of the access side of the lamp socket, and the flat bar has a recess formed therein being larger than the cross section of the lamp.

In accordance with a further feature of the invention, the electrically conductive and protectively grounded protective element has a flat bar disposed in front of the access side of the lamp socket, the flat bar has a recess formed therein being larger than the cross section of the lamp, and the protective element tubularly surrounds the lamp socket or has a tubular portion surrounding the lamp socket.

In accordance with an added feature of the invention, there are provided struts extending past the lamp socket on which the protective element is disposed.

Through both provisions, the electrically conductive protective element is electrically conductively connected with protectively grounded housing parts.

In accordance with a concomitant feature of the invention, the protective element is three-dimensionally spaced from the lamp socket. As a result, not only is the leakage current spacing between the electrically conductive parts increased, but also the electrically conductive and therefore typically highly thermally conductive protective element additionally acts as a heat shield, which thermally shields the contact point between the contact prongs of the lamp and the contact parts of the lamp socket. This is particularly desirable when the electric lighting device is used in ovens. The high baking temperatures in fact represent a major load on these plug connections.

Other features which are considered as characteristic for the invention are set forth in the appended claims.

Although the invention is illustrated and described herein as constructed in an electric lighting device for household appliances such as ovens, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
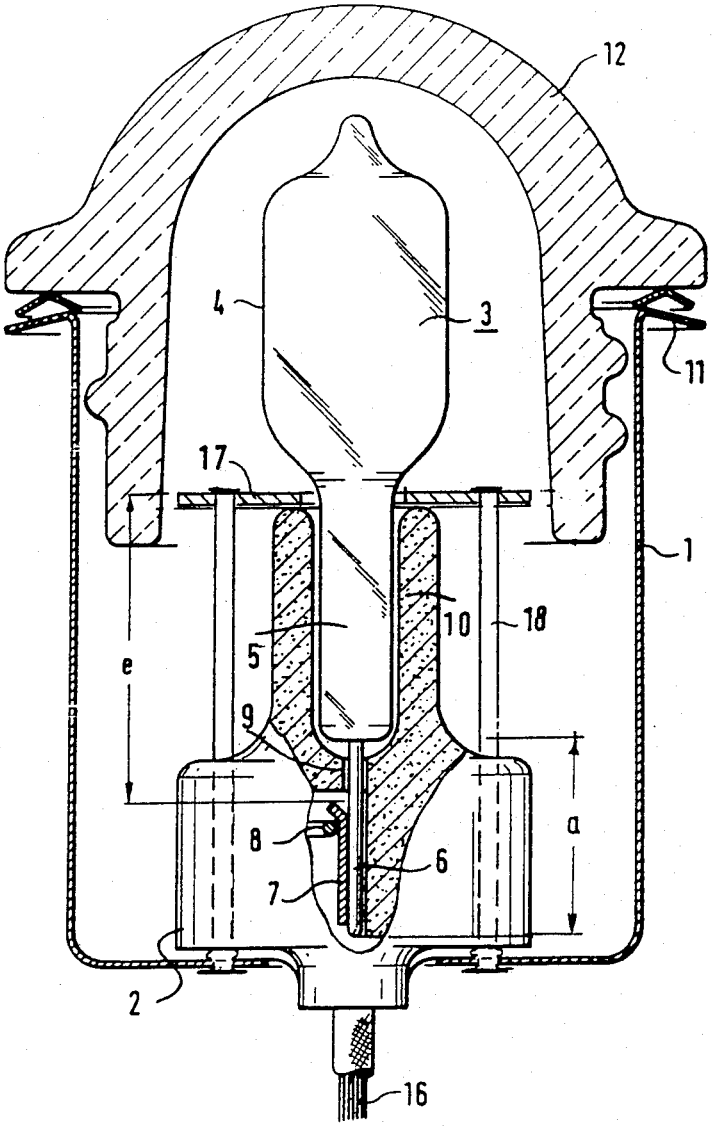

FIG. 1 is a fragmentary, diagrammatic, partly broken-away, cross-sectional view of a configuration having an electrically conductive protective element which tubularly surrounds a lamp socket formed of insulating material; and FIG. 2 is a view similar to FIG. 1 of a screen-like, electrically conductive and protectively grounded protective element, which is disposed on struts laterally extending past the lamp socket formed of insulating material.

Referring now in detail to FIGS. 1 and 2 of the drawings as a whole, there is seen a lighting device according to the invention in the form of a separate light on a highly enlarged scale.

A lamp socket 2 formed of electrically insulating material such as ceramic is secured in a cup-shaped lamp housing 1 which is open at one end. A lamp 3, typically a low-voltage lamp, is plugged into the lamp socket 2. The lamp 3 has a typically cylindrical bulb 4, which is extended to form a constricted or tapered lamp base 5 as well as contact prongs 6 having a length a. In the illustrated plugged-in position of the lamp 3, the contact prongs 6 are in contact with electric contact parts 7 of the lamp base. The contact parts 7 extend along the contact prongs 6 in the form of contact rails and are pressed against the contact prongs 6 by springs 8. The touchable zone or zone of contact between the contact part 7 and the contact prongs 6 will be referred to below as the plug contact path. The contact prongs 6 are pre-centered with respect to the contact parts 7 through plug-in openings 9 at an access side of the socket. The lamp socket 2 has a formed-on tubular extension 10 which has a relatively large diameter and which adjoins the plug-in openings 9. At least most of the lamp base 5 fits into the extension 10.

A lens-shaped transparent glass shade 12 is screwed onto a flange 11 of the lamp housing 1. The glass shade 12 is unscrewed for inserting or changing the lamp 3. If the lamp 3 is removed from the lamp socket 2, then provision should be made to prevent the danger of manual contact with the contact prongs 6, when they are not yet completely removed from the contact parts 7.

In order to eliminate this danger, in the embodiment of FIG. 1 a protective element 13 formed of electrically conductive material is disposed above the lamp socket 2 formed of insulating ceramic material. The protective element 13 cylindrically surrounds the tubular extension 10 of the lamp socket 2 formed of insulating ceramic material. In the upper region, the protective element 13 is extended to the vicinity of the wall of the lamp base 5. In the lower region, the protective element 13 is electrically conductively connected to the lamp housing 1 through connecting bolts 14 passing through the lamp socket 2 and thus the protective element 13 can be protectively grounded with the lamp housing 1. The distance e between the upper edge of the protective element 13 and the closest possible contact location between the contact prongs 6 and the contact parts 7, is greater than the length a of the contact prongs 6 and the dimension of the wall thickness of the protective element 13, and in fact is greater by an amount sufficient for the required margin of safety. Through the use of the tubular extension 10 of the lamp socket 2, the distances between the current-carrying part and the protectively grounded part on the ceramic surface are lengthened to the required extent for preventing current leakage paths. An air gap is provided between the inner wall surface of the protective element 13 and the lamp socket 2, in which limited air convection is possible. As a result of this provision, the electrically conductive, protectively grounded protective element 13 also provides a heat shield with respect to the lamp socket 2, so that the electrical contact point between the contact prongs 6 and the contact parts 7 is particularly thermally relieved.

In FIG. 2, a flat-bar-like protective element 17 is provided for touch or contact protection. The element 17 is secured to the lamp housing 1 through struts 18 and is electrically conductively connected t the lamp housing. The spacing ratios to be sought are equivalent to those in the embodiment of FIG. 1.

The foregoing is a description corresponding in substance to German Application Pat. No. 37 42 509.9, dated Dec. 15, 1987, the International priority of which is being claimed for the instant application, and which is hereby made part of this application. Any material discrepancies between the foregoing specification and the aforementioned corresponding German application are to be resolved in favor of the latter.

What is claimed:

1. Lighting device for household appliances such as ovens, comprising an electric lamp socket formed of electrically insulating material preventing leakage currents, contact parts disposed in said socket, said socket having an access side with a plug-in opening formed therein into which a lamp with a glass bulb, a lamp base of insulating material and contact prongs protruding from said lamp base is to be plugged into contact with said contact parts in a given plug-in direction, and an electrically conductive and protectively grounded protective element covering at least said access side of said lamp socket and extending to the vicinity of at least one of the glass bulb and the lamp base, said protective element and said contact parts being spaced apart by a distance being greater than the length of said contact prongs by a required margin of safety, as seen in said given plug-in direction.

2. Lighting device according to claim 1, wherein said electrically conductive and protectively grounded protective element is a flat bar disposed in front of said access side of said lamp socket, and said flat bar has a recess formed therein being larger than the cross section of the lamp.

3. Lighting device according to claim 1, wherein said electrically conductive and protectively grounded protective element has a flat bar disposed in front of said access side of said lamp socket, said flat bar has a recess formed therein being larger than the cross section of the lamp, and said protective element tubularly surrounds said lamp socket.

4. Lighting device according to claim 1, wherein said electrically conductive and protectively grounded protective element has a flat bar disposed in front of said access side of said lamp socket, said flat bar has a recess formed therein being larger than the cross section of the lamp, and said protective element has a tubular portion surrounding said lamp socket.

5. Lighting device according to claim 2, including struts extending past said lamp socket on which said protective element is disposed.

6. Lighting device according to claim 1, wherein said protective element is three-dimensionally spaced from said lamp socket.

* * * * *